US008991134B2

(12) United States Patent
Wheeler

(10) Patent No.: US 8,991,134 B2
(45) Date of Patent: Mar. 31, 2015

(54) RECONFIGURED MODULAR BUILDING UNIT AND METHOD

(71) Applicant: Carson Wheeler, Wimberley, TX (US)

(72) Inventor: Carson Wheeler, Wimberley, TX (US)

( * ) Notice: Subject to any disclaimer, the term of this patent is extended or adjusted under 35 U.S.C. 154(b) by 0 days.

(21) Appl. No.: 14/176,111

(22) Filed: Feb. 9, 2014

(65) Prior Publication Data

US 2014/0223840 A1 Aug. 14, 2014

Related U.S. Application Data

(60) Provisional application No. 61/763,949, filed on Feb. 13, 2013.

(51) Int. Cl.

| | |
|---|---|
| ***E04H 1/02*** | (2006.01) |
| ***E04B 1/343*** | (2006.01) |
| *E04H 1/12* | (2006.01) |

(52) U.S. Cl.

CPC ..... *E04B 1/343* (2013.01); *E04H 2001/1283* (2013.01)

USPC ..... 52/745.02; 52/79.9; 52/745.01; 220/1.5; 220/4.27

(58) Field of Classification Search

USPC ..... 52/79.1, 79.2, 79.9, 79.12, 52/745.01–745.03; 220/1.5, 4.26, 4.27

See application file for complete search history.

(56) References Cited

U.S. PATENT DOCUMENTS

| | | | | |
|---|---|---|---|---|
| 8,166,714 | B2 * | 5/2012 | Ziegelman | 52/79.2 |
| 8,186,110 | B2 * | 5/2012 | Green | 52/79.9 |
| 8,484,929 | B1 * | 7/2013 | Begdouri | 52/745.03 |
| 2007/0271857 | A1 * | 11/2007 | Heather et al. | 52/79.9 |
| 2011/0162293 | A1 * | 7/2011 | Levy et al. | 52/79.9 |

* cited by examiner

*Primary Examiner* — William Gilbert

(74) *Attorney, Agent, or Firm* — James R Bell

(57) ABSTRACT

A modular building unit includes a top member, a bottom member, a plurality of wall members and at least one door member. The at least one door member and the wall members include a plurality of uniform-sized panel members. First attachment members are provided to reinforce openings in the unit. Second attachment members are provided on the uniform-sized panel members. The uniform-sized panel member are mounted in the openings and interconnected.

16 Claims, 11 Drawing Sheets

36
36
36

RECONFIGURED MODULAR BUILDING UNIT AND METHOD

CROSS REFERENCE TO RELATED APPLICATIONS

This application is related to and claims priority to Provisional Application No. 61/763,949, filed Feb. 13, 2013.

BACKGROUND

The present disclosure relates generally to a modular building unit and more particularly to a building unit reconfigured from a shipping container.

Metal shipping containers are shipped by road, rail and sea. They are capable of being stacked and are easily loaded and unloaded. Once unloaded, and unless a return load is located, it is often not economically feasible to be returned empty to their origin. Thus, empty containers are readily available and economical to purchase. It would be of benefit to utilize such containers including a recycle operation whereby the containers are reconfigured for a new use.

SUMMARY

One embodiment of the present disclosure provides a modular building unit comprising a top member, a bottom member, a plurality of wall members and at least one door member. The at least one door member and the wall members include a plurality of uniform-sized panel members. First attachment members are provided to reinforce openings in the unit. Second attachment members are provided on the uniform-sized panel members. The uniform-sized panel members are mounted in the openings in response to the first and second attachment members being interconnected.

DETAILED DESCRIPTION

Figure 1:
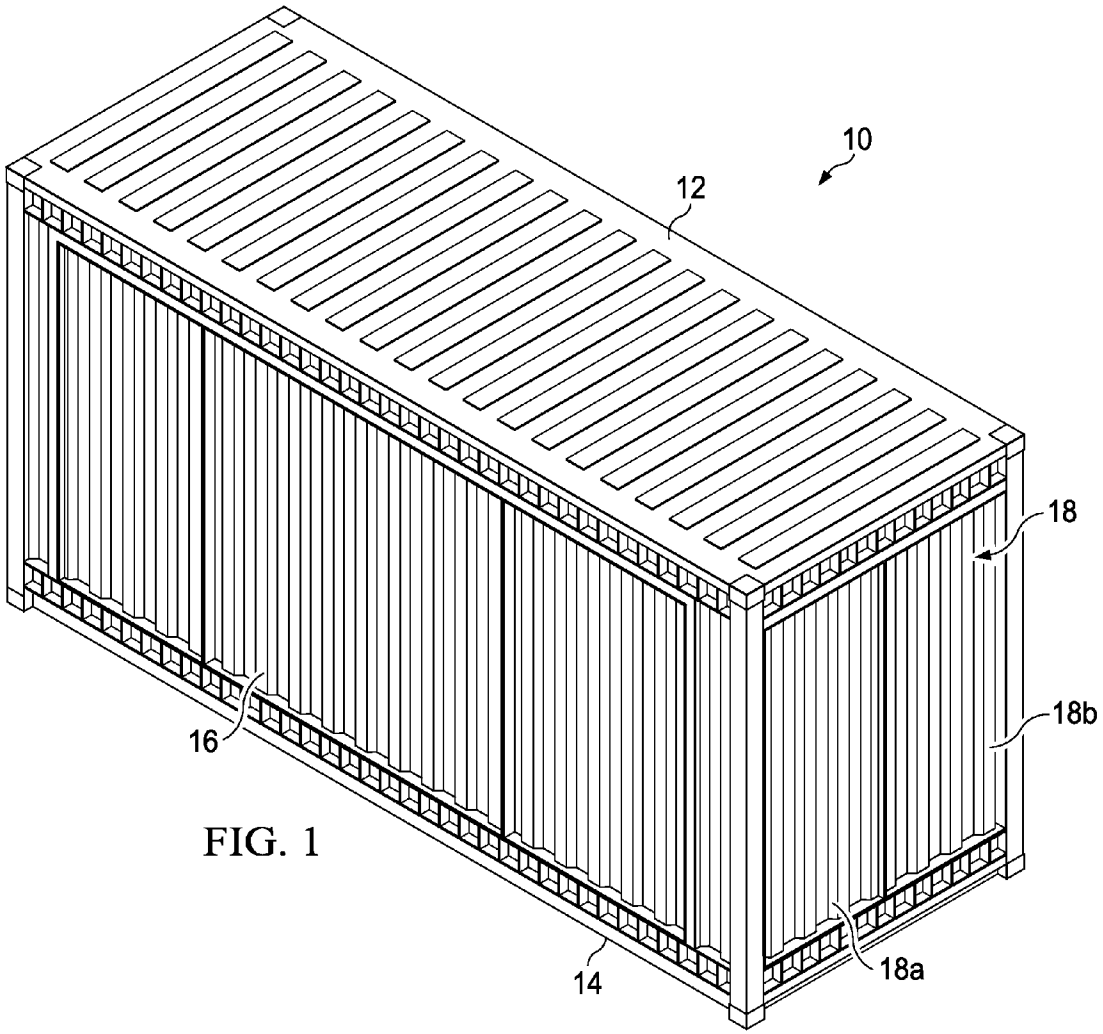
FIG. 1 is a perspective view illustrating an embodiment of a shipping container.
Figure 2:
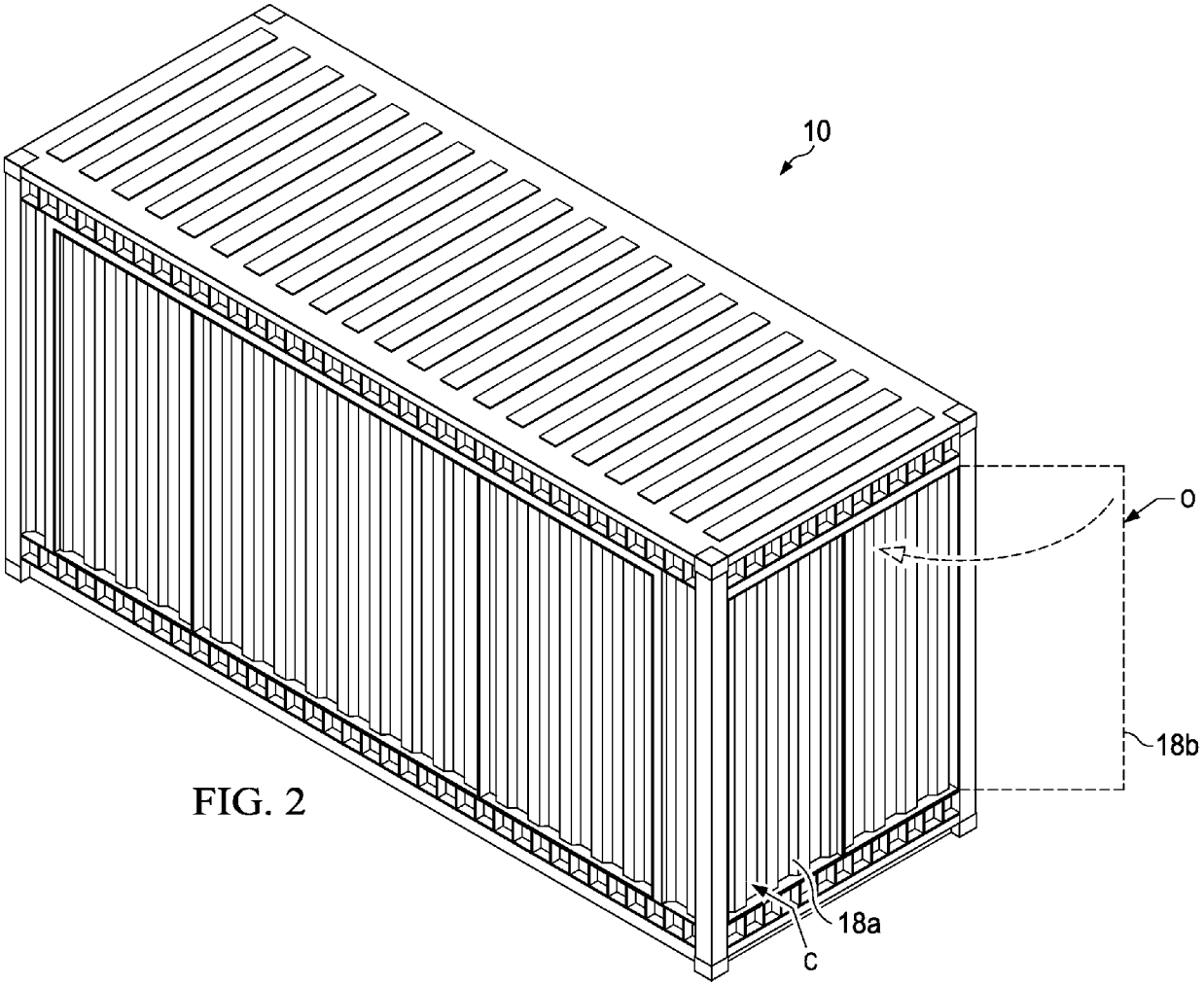
FIG. 2 is a perspective view illustrating the shipping container of FIG. 1.

A shipping container 10, FIG. 1, includes a top surface member 12, a bottom surface member 14, a plurality of wall surface members 16 and at least one door member 18. Typically, door member 18 includes a double door including two door panels 18*a*, 18*b*, movable between open and closed positions. The door member 18, when in a closed position C, FIG. 2, provides a wall member similar to wall surface members 16. The door members 18*a* and/or 18*b*, when in an open position 0, permit loading and unloading of the container 10.

Figure 3:
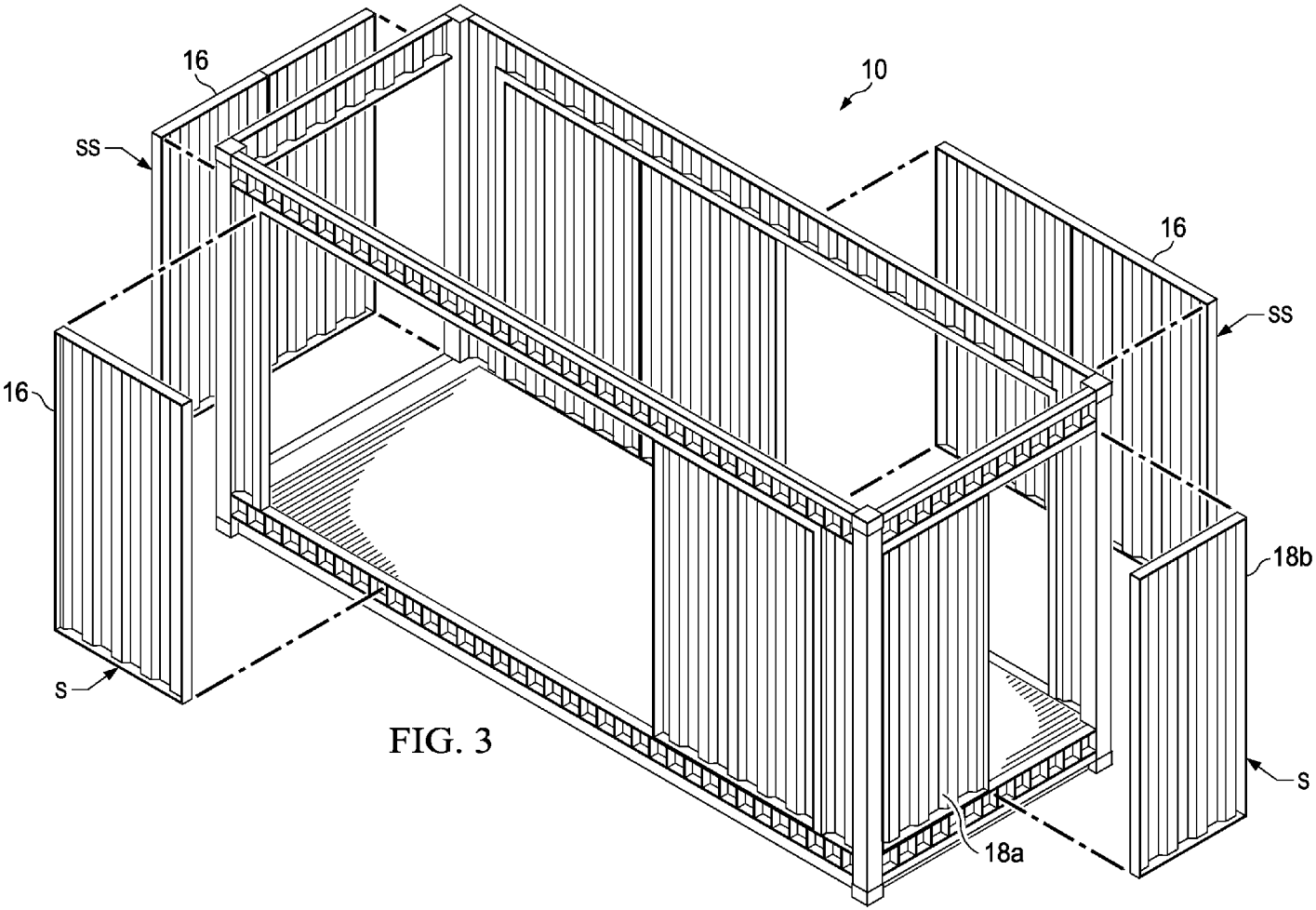
FIG. 3 is a perspective view illustrating an embodiment of a shipping container having wall and door panels removed.

The container 10, FIG. 3, illustrates one of the door members 18*b* removed and formed into a panel member. The remaining wall members 16 can also be removed and formed into uniform sized panel members. By uniform sized, the panel members can be of any size, but in the example illustrated, are in a first size S as door member 18*b*, or a second size SS which can be double the size of panel S. The panels S and SS can be stored for future use as will be discussed below.

Figure 4:
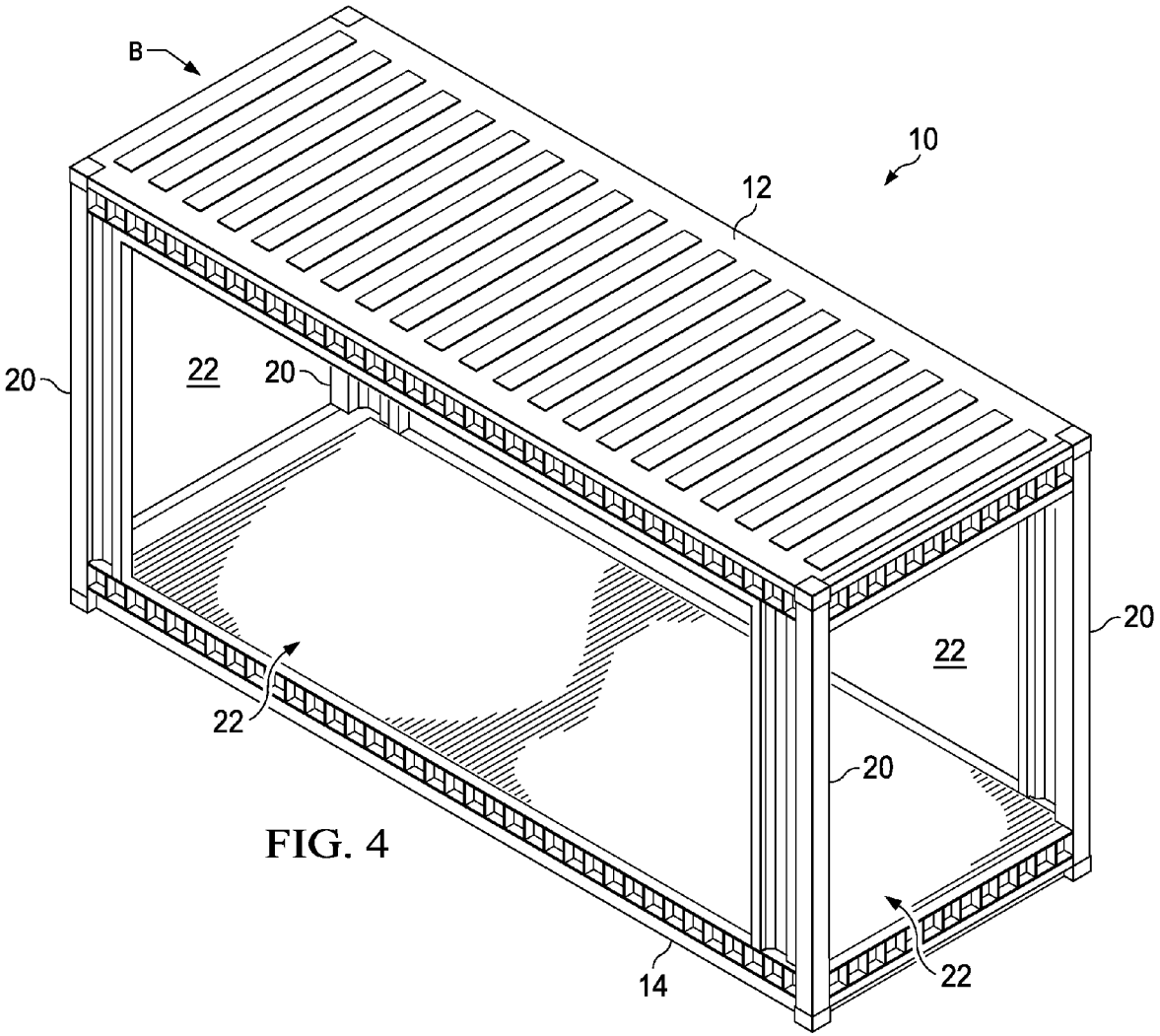
FIGS. 4-6 are perspective views illustrating embodiments of shipping containers reconfigured into building units.
Figure 5:
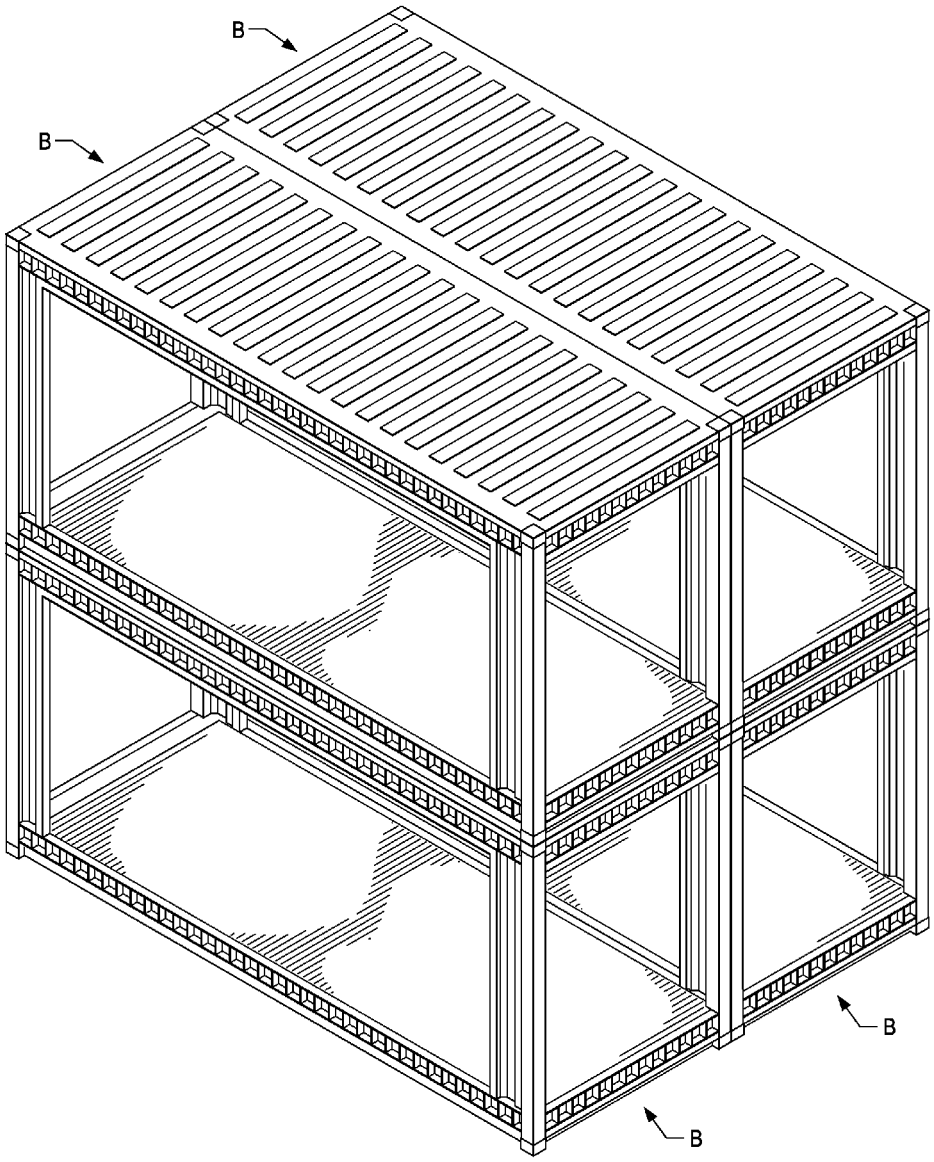

With all the panels S and SS removed, FIG. 4, the container 10 exposes four openings 22 and forms a basic building unit B for use alone or in combination with a plurality of such units, FIG. 5. Each basic building unit B includes top surface member 12, bottom surface member 14 and a plurality of corner members 20 which support the top member 12 in a spaced apart relationship with the bottom member 14, see FIGS. 4 and 5. In FIG. 5, a combination of four basic building units B are illustrated in a stacked, i.e. double story and side-by-side relationship, as an example. However, any combination of side-by-side, stacked, i.e. u-shaped, and end-to-end, in both a single or double story combination is possible, to describe a few possible examples.

Figure 6:
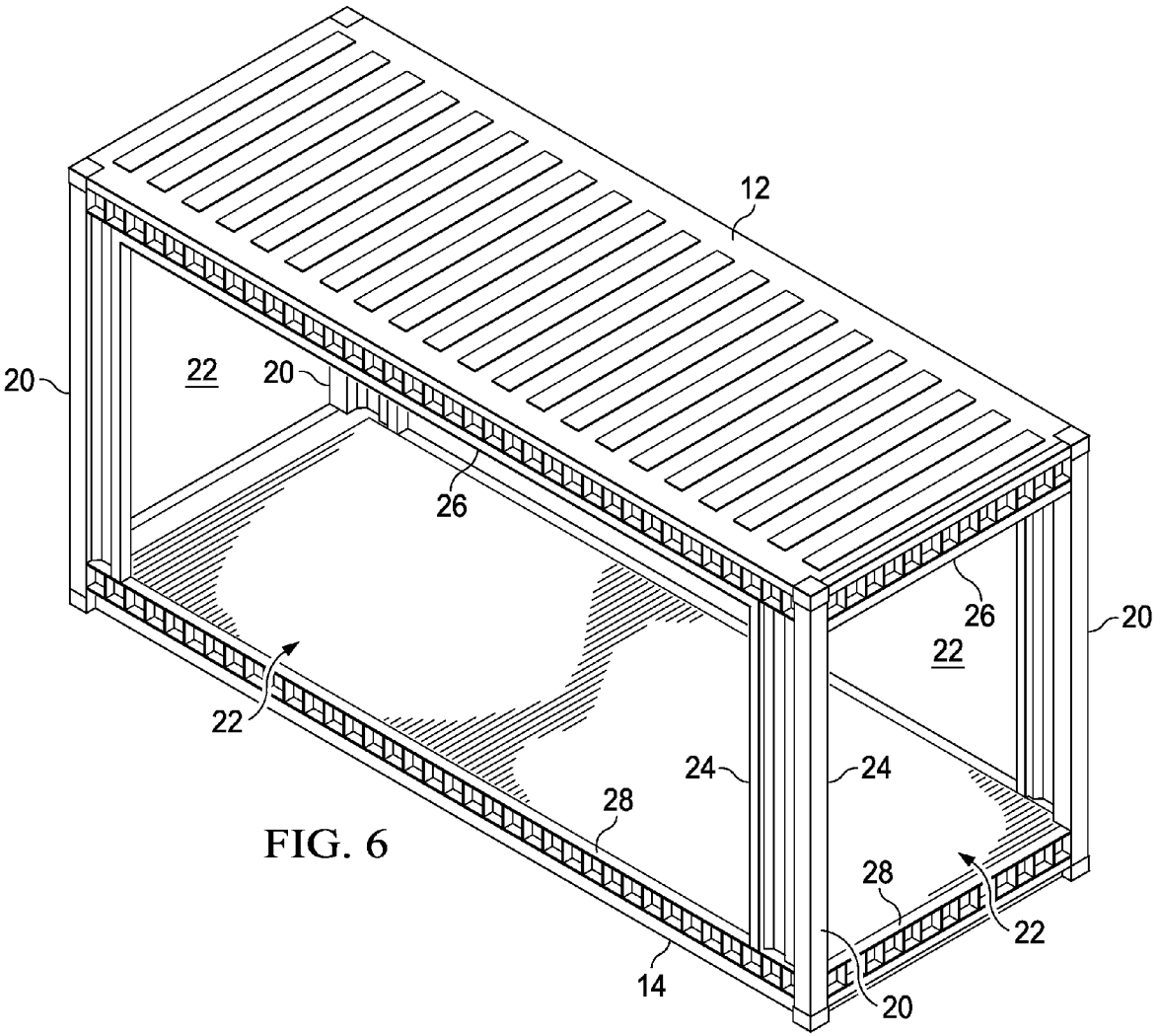
Figure 7:
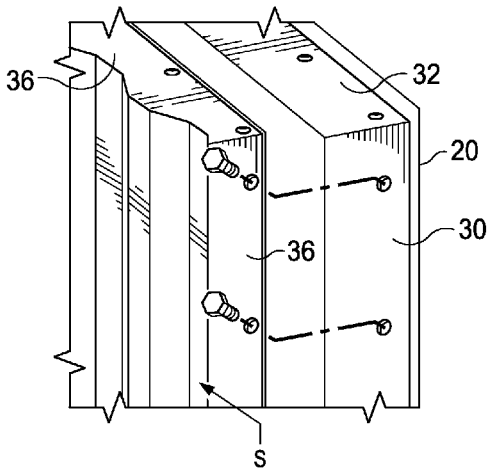
FIGS. 7-12 are perspective views illustrating embodiments of attached panel members.
Figure 8:
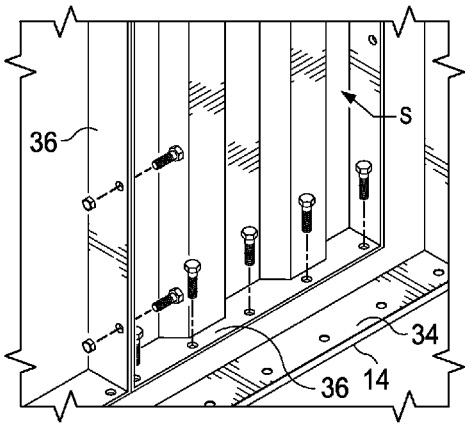
Figure 9:
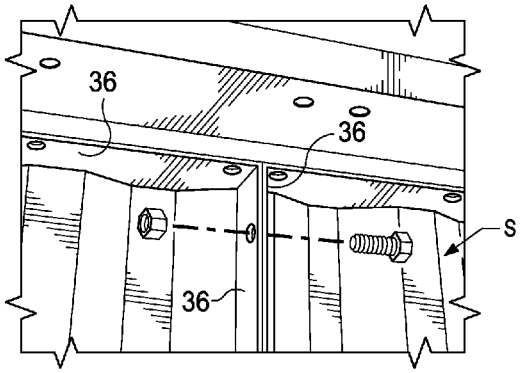
Figure 10:
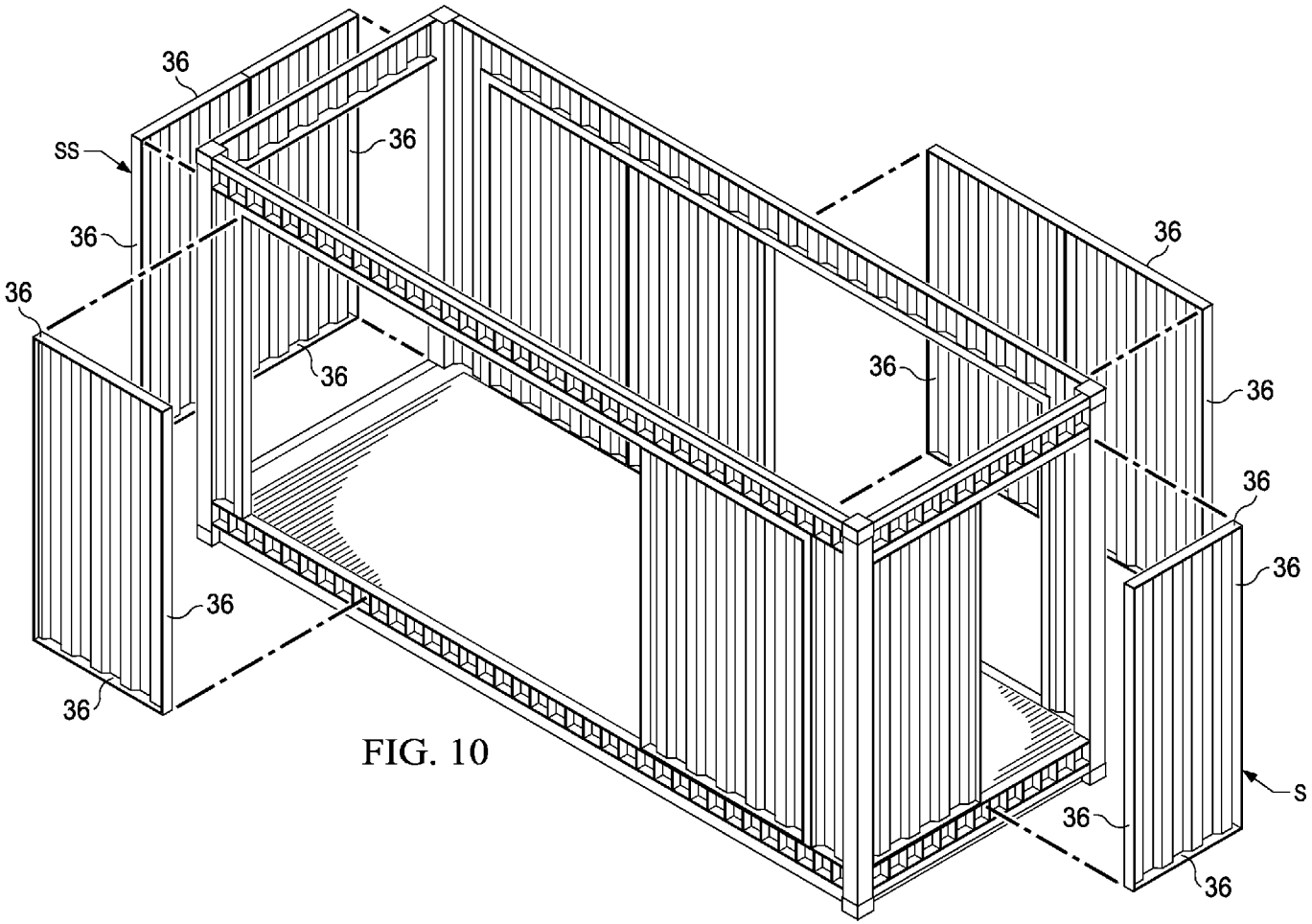
Figure 11:
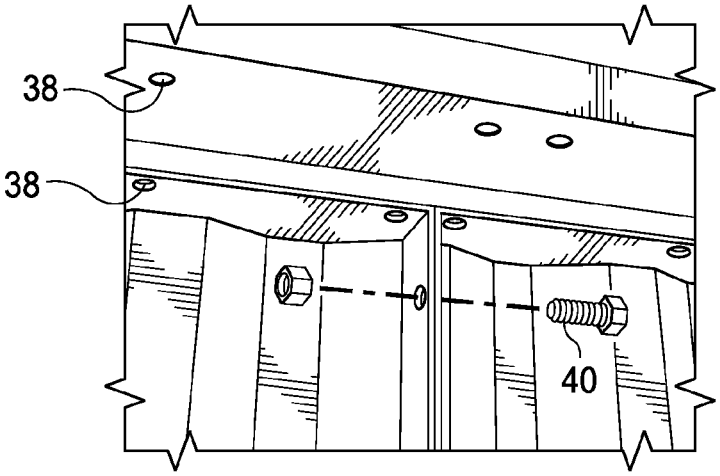
Figure 12:
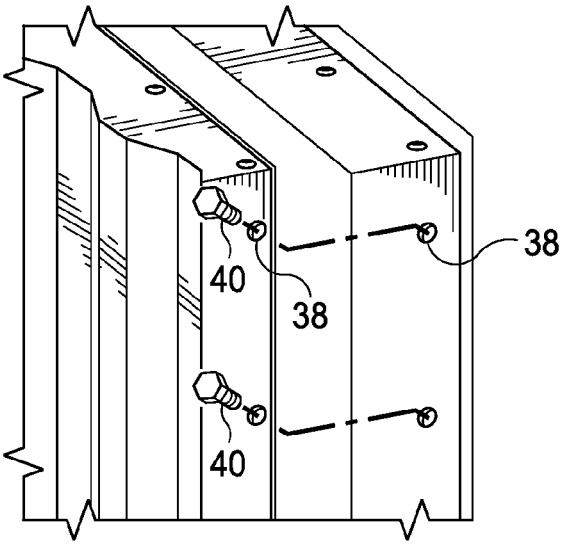

A plurality of attachment members in the form of peripheral flanges, are provided around openings 22, FIG. 6, formed by removal of the wall surface members 16 as discussed above. Such flanges are provided on each building unit B along the exposed edges 24 of each corner member 20, along the exposed edges 26 of top surface member 12 and along exposed edges 28 of exposed bottom surface member 14. In FIG. 7, one such flange 30 is illustrated adjacent one of the corner members 20, and another such flange 32 is illustrated adjacent the top surface member 12. A further such flange 34, FIG. 8, is illustrated adjacent the bottom surface member 14.

Furthermore, flanges 36, FIGS. 7-12 are provided along all four peripheral edges of each panel S and each panel SS. The flanges 36 provide attachment members on each of the above-mentioned panel members S and SS. All flanges described above, i.e. panel flanges and building unit flanges, include a plurality of apertures 38 for receiving a fastener 40 which is provided in a single size to accommodate attaching panels to adjacent panels, FIG. 11, and also attaching panels to the basic building unit B, FIG. 12. thus, spacing between all paired or mating apertures is uniform.

Figure 13:
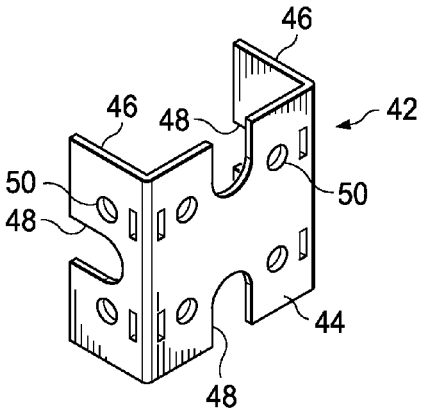
FIG. 13 is a perspective view illustrating an embodiment of an insert member.
Figure 15:
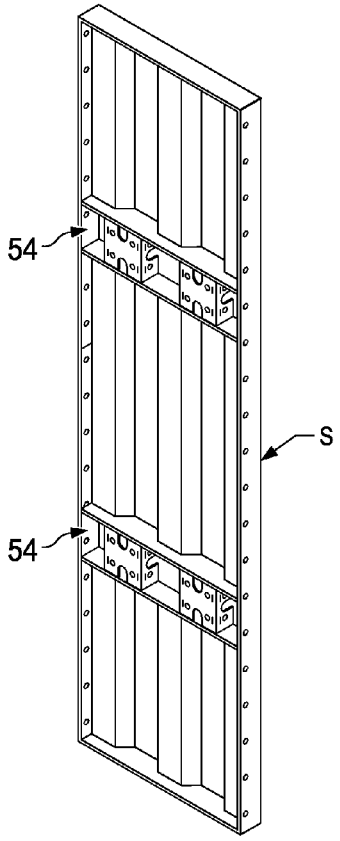
FIG. 15 is a perspective view illustrating an embodiment of a panel member including a plurality of universal connection members.
Figure 14:
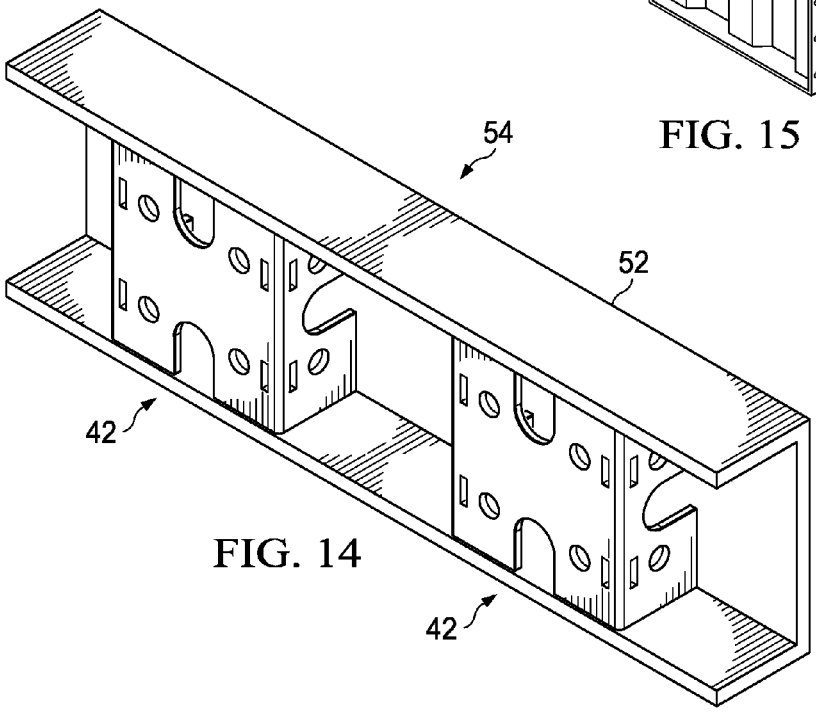
FIG. 14 is a perspective view illustrating an embodiment of a universal connection member including a plurality of insert members attached to a channel member.

A fascia attachment insert member 42, FIG. 13, includes a planar base member 44 and a plurality of spaced apart flange members 46. The base member 44 and each flange member 46 include a plurality of slot members 48 and apertures 50 formed therein. A channel member 52, FIG. 14, includes one or more fascia attachment insert members 42 (hereinafter insert members 42) mounted therein. Each of the panels S and SS, see FIGS. 15 and 16, include at least one universal connection member 54 which comprises a channel member 52, FIG. 14, and at least one of the insert members 42, FIG. 13, mounted in the respective channel member 52. Due to the presence of the insert members 42, the slot members 48 and apertures 50 therein, a plurality of external fascia selected materials (not shown) can be attached to a respective panel S or SS by a suitable fastener or connector member (not shown). Also, hand or tool access into the insert member 42 is provided via the larger of the slot members 48. In addition, it can be seen in FIG. 16 that a plurality of inserts 42 are set into channels 52 along the top surface member 12 and bottom surface member 14 of the reconfigured building unit B.

Figure 16:
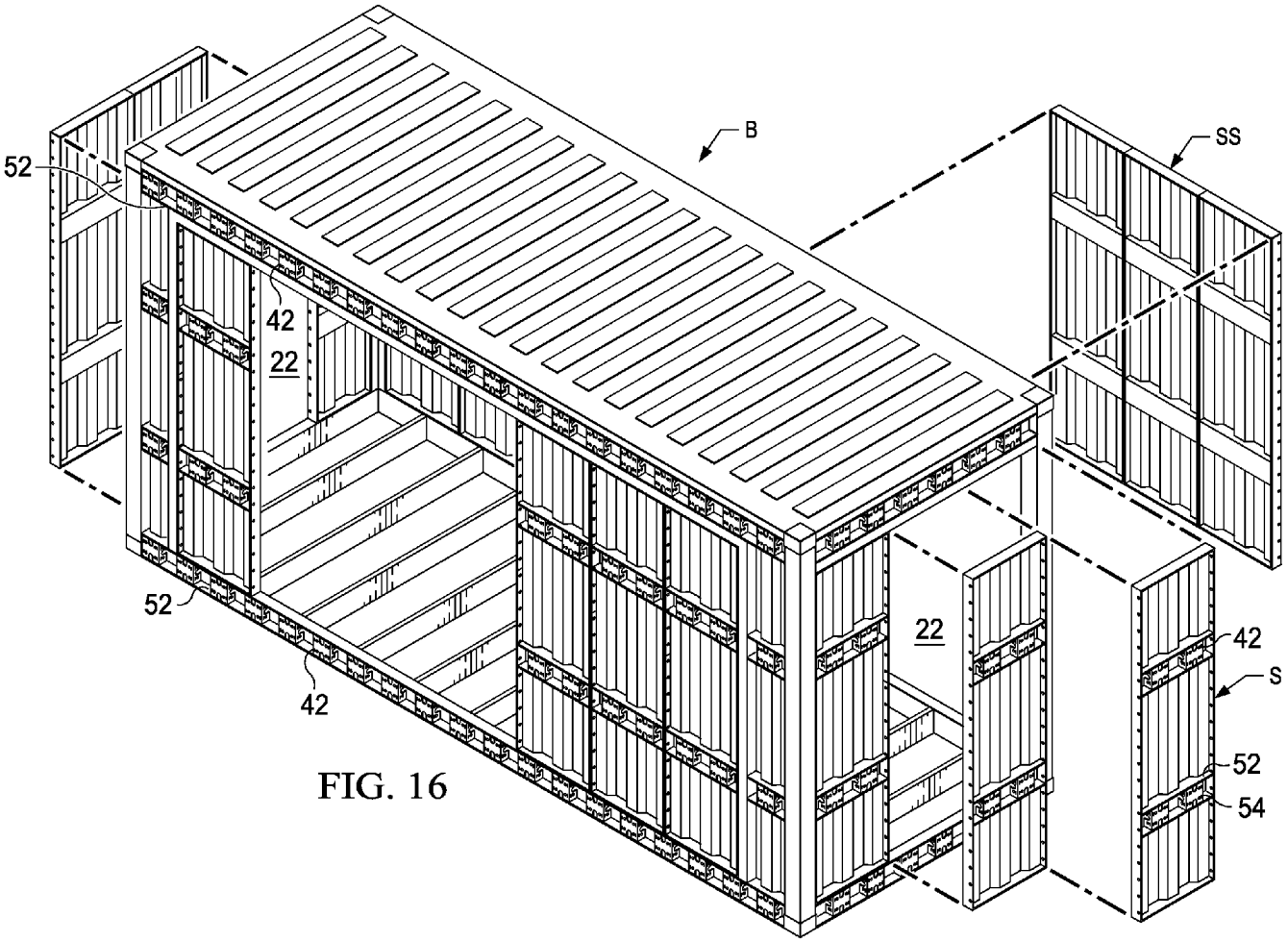
FIG. 16 is a perspective view illustrating an embodiment of a basic building unit including a plurality of panel members.

Referring again to the basic building unit B, FIG. 16, and uniform panels S and SS, a modular building system may be used to form building structures by any combination of side-by-side, stacked, u-shaped and end-to-end assemblies as mentioned above. In addition, the uniform panels S and SS may be selectively installed and positioned in the openings 22 to form window openings, door openings and passageways in such building structures, see FIGS. 15 and 16.

Although illustrative embodiments have been shown and described, a wide range of modification, change and substitution is contemplated in the foregoing disclosure and in some instances; some features of the embodiments may be employed without a corresponding use of other features. Accordingly, it is appropriate that the appended claims be construed broadly and in a manner consistent with the scope of the embodiments disclosed herein.

What is claimed is:

1. A method of reconfiguring a metal shipping container into a modular building unit comprising:

providing a shipping container including a top member, a bottom member, a plurality of wall members and at least one door member;

removing the at least one door member whereby a first opening is provided in the container between the top and bottom members;

removing the plurality of wall members whereby additional openings are provided in the container between the top and bottom members;

forming the at least one door member and the plurality of wall members into a plurality of uniform-sized panel members;

framing and reinforcing all of the openings with a plurality of first attachment members;

providing second attachment members on the uniform-sized panel members; and positioning and attaching some of the uniform-sized panel members in selected ones of the openings by joining the first and second attachment members whereby a modular building unit is configured.

2. The method of claim 1, further comprising:

using a single sized fastener for the attaching.

3. The method of claim 1, further comprising:

providing a universal connector member attached to each panel member.

4. The method of claim 3, further comprising:

forming the universal connector member including at least one insert member secured in a channel member.

5. The method of claim 3, further comprising:

providing a plurality of universal connector members attached to each panel member.

6. The method of claim 5, further comprising:

forming each universal connector member including at least one insert member secured in a channel member.

7. The method of claim 1, further comprising:

each insert member having a planar base member and a pair of spaced apart flange members.

8. The method of claim 7, wherein the planar base member and the flange members each include a plurality of slots and apertures formed therein.

9. A method of reconfiguring a plurality of metal shipping containers into a modular building unit comprising:

providing a first shipping container and a second shipping container, each container including a top member, a bottom member, a plurality of wall members and at least one door member;

removing from each container, the at least one door member whereby a first opening is provided in each container between the top and bottom members;

removing from each container, the plurality of wall members whereby additional openings are provided in each container between the top and bottom members;

forming the at least one door member and the plurality of wall members into a plurality of uniform-sized panel members;

framing and reinforcing all of the openings in each container with a plurality of first attachment members;

providing second attachment members on each of the uniform-sized panel members;

attaching the first shipping container to the second shipping container; and positioning and attaching some of the uniform-sized panel members in selected ones of the openings by joining the first and second attachment members whereby a modular building unit is configured.

10. The method of claim 9, further comprising:

using a single sized fastener for the attaching.

11. The method of claim 9, further comprising:

providing a universal connector member attached to each panel member.

12. The method of claim 11, further comprising:

forming the universal connector member including at least one insert member secured in a channel member.

13. The method of claim 12, further comprising:

each insert member having a planar base member and a pair of spaced apart flange members.

14. The method of claim 13, wherein the planar base member and the flange members each include a plurality of slots and apertures formed therein.

15. The method of claim 9, further comprising:

providing a plurality of universal connector members attached to each panel member.

16. The method of claim 15, further comprising:

forming each universal connector member including at least one insert member in a channel member.

* * * * *